US005099462A

United States Patent [19]

Karowski

[11] Patent Number: 5,099,462

[45] Date of Patent: Mar. 24, 1992

[54] CONSTRUCTION HAT TIMEPIECE APPARATUS

[76] Inventor: Robert E. Karowski, 260 Main St., Apt. 2C, Leeds, Mass. 01053

[21] Appl. No.: 694,683

[22] Filed: May 2, 1991

[51] Int. Cl.[5] ..... G04B 37/00

[52] U.S. Cl. ..... 368/10; 368/227

[58] Field of Search ..... 368/10, 227

[56] References Cited

U.S. PATENT DOCUMENTS

| | | | |
|---|---|---|---|
| Re. 32,576 | 1/1988 | Pastore | 368/10 |
| 3,983,688 | 10/1976 | Kockinos | 368/10 |
| 4,445,786 | 5/1984 | Jackson | 368/10 |
| 4,526,473 | 7/1985 | Zahn, III | 368/10 |
| 4,751,691 | 6/1988 | Perera | 368/10 |
| 4,802,550 | 2/1989 | Poore | 368/10 |

*Primary Examiner*—Bernard Roskoski
*Attorney, Agent, or Firm*—Leon Gilden

[57] ABSTRACT

The present invention provides a rigid construction hat defining a shell mounting a timepiece for ease of visibility by an individual to minimize accidental injury in the typical wearing of a wristwatch. The timepiece is removably mounted relative to a bottom surface of the brim via magnetic means and includes illumination means to provide light to four quadrants of the timepiece through fiber optic cables.

2 Claims, 4 Drawing Sheets

CONSTRUCTION HAT TIMEPIECE APPARATUS

BACKGROUND OF THE INVENTION

1. Field of the Invention

The field of invention relates to timepiece and clock apparatus, and more particularly pertains to a new and improved construction hat timepiece apparatus wherein the same presents a timepiece in a convenient orientation relative to a construction hat.

2. Description of the Prior Art

Timepiece of various types are utilized in the prior art for convenient positioning and mounting of a timepiece relative to an article. The instant invention provides an organization wherein the timepiece is positioned to avoid an individual wearing a wrist watch with danger in typical construction sites.

Prior art utilized incorporating a timepiece is exemplified in U.S. Pat. No. 4,771,410 to Kolibaba, et al. wherein a clock system utilizes a bugle for simulation of a predetermined tune, such as "Reveille" to awaken a user.

Various design patents such as typified in U.S. Des. Pat. Nos. 292,667; 289,424; 296,533; and 297,527 illustrate timepieces utilized in various organizations.

As such, it may be appreciated that there continues to be a need for a new and improved construction hat timepiece apparatus providing availability of a timepiece to a bottom surface of a construction hat brim for ease of visibility of the timepiece during conventional use of the construction hat.

SUMMARY OF THE INVENTION

In view of the foregoing disadvantages inherent in the known types of timepiece apparatus now present in the prior art, the present invention provides a construction hat timepiece apparatus wherein the same mounts a timepiece to a bottom surface of a brim for ease of visibility to a user thereof. As such, the general purpose of the present invention, which will be described subsequently in greater detail, is to provide a new and improved construction hat timepiece apparatus which has all the advantages of the prior art clock apparatus and none of the disadvantages.

To attain this, the present invention provides a rigid construction hat defining a shell mounting a timepiece therewithin for ease of visibility by an individual to minimize accidental injury in the typical wearing of a wrist watch and the like. The timepiece is removably mounted relative to a bottom surface of the brim, wherein a modification of the invention includes illumination means to effect visibility of the timepiece during conditions of limited light availability.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved construction hat timepiece apparatus which has all the advantages of the prior art clock apparatus and none of the disadvantages.

It is another object of the present invention to provide a new and improved construction hat timepiece apparatus which may be easily and efficiently manufactured and marketed.

It is a further object of the present invention to provide a new and improved construction hat timepiece apparatus which is of a durable and reliable construction.

An even further object of the present invention is to provide a new and improved construction hat timepiece apparatus which is susceptible of a low cost of manufacture with regard to both materials and labor, and which accordingly is then susceptible of low prices of sale to the consuming public, thereby making such construction hat timepiece apparatus economically available to the buying public.

Still yet another object of the present invention is to provide a new and improved construction hat timepiece apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
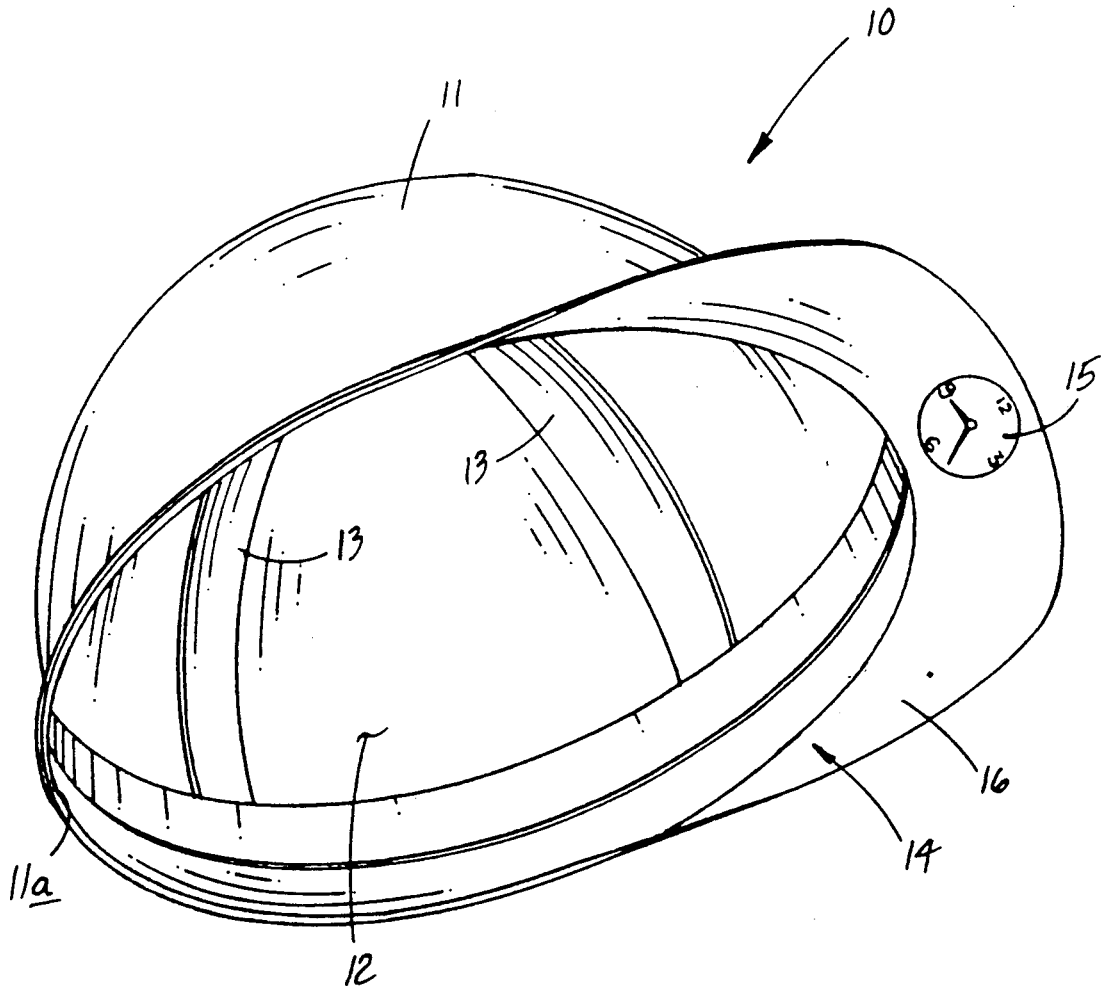
FIG. 1 is an isometric illustration of the instant invention.
Figure 2:
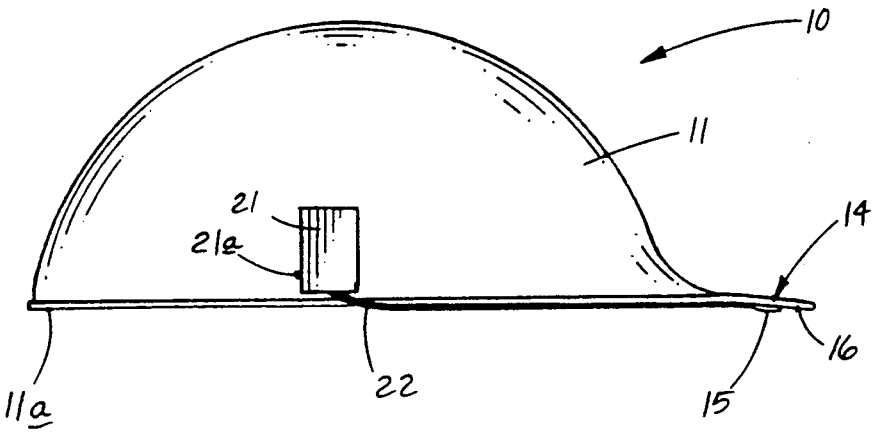
FIG. 2 is an orthographic side view of a modification of the instant invention.
Figure 3:
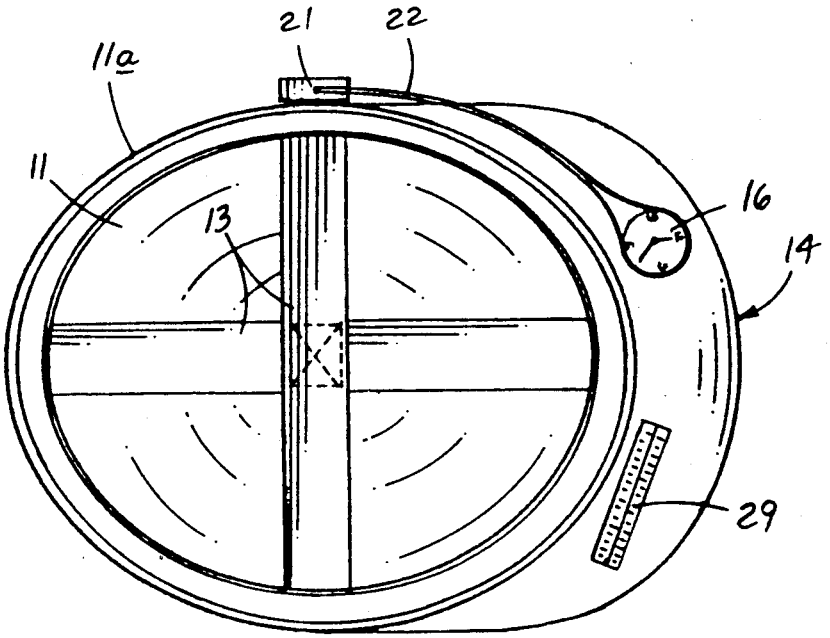
FIG. 3 is an orthographic bottom view of the modification of the instant invention.
Figure 4:
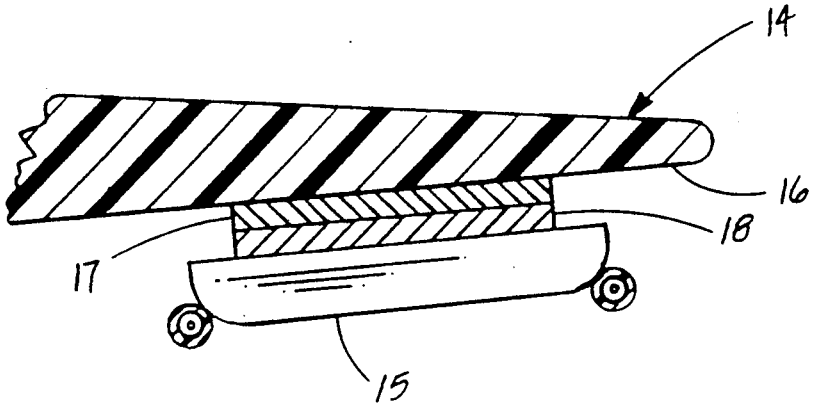
FIG. 4 is an orthographic cross-sectional illustration of the hat brim of the invention.
Figure 5:
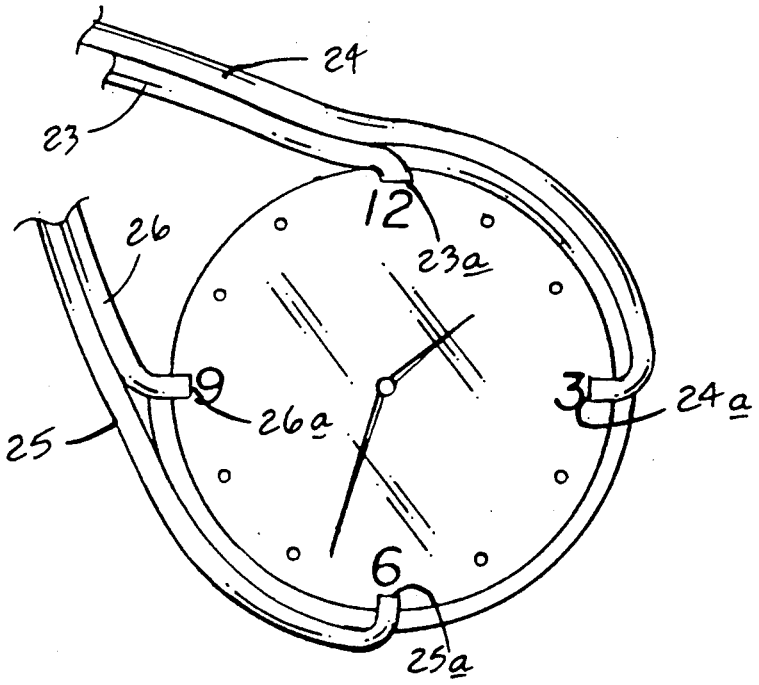
FIG. 5 is an enlarged orthographic view of the timepiece member.
Figure 6:
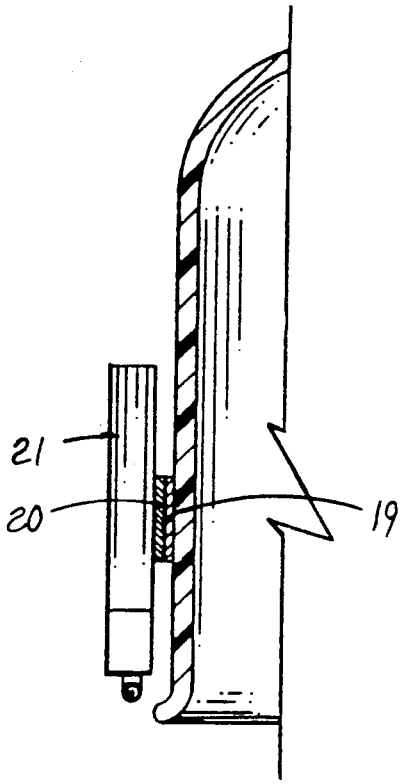
FIG. 6 is an orthographic end view of the mounting of the fiber optic cable housing of the invention.
Figure 7:
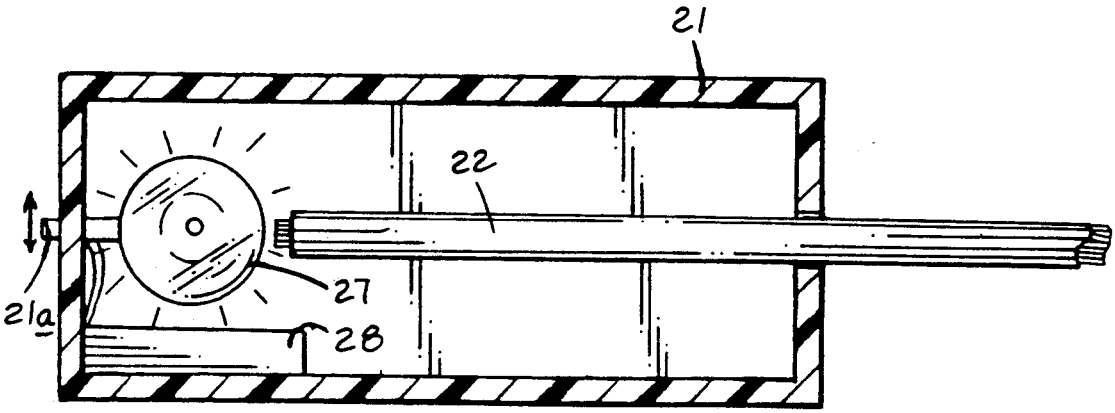
FIG. 7 is an orthographic cross-sectional illustration of the fiber optic cable housing.

With reference now to the drawings, and in particular to FIGS. 1 to 7 thereof, anew and improved construction hat timepiece apparatus embodying the principles and concepts of the present invention and generally designated by the reference numeral 10 will be described.

More specifically, the construction hat timepiece apparatus 10 of the instant invention essentially comprises a hat shell 11 of a rigid construction defining a generally semi-spherical configuration, including a concave cavity 12 therewithin utilizing spherically crossed suspension straps 13 mounted within the cavity for support and mounting of the hat shell 11 onto an individual. The hat shell 11 includes a generally circular lower edge 11*a*, with a brim flange 14 fixedly mounted to the edge 11*a* extending generally outwardly thereof. The brim flange 14 includes a brim flange bottom surface 16, with a clock member 15 mounted thereon.

FIGS. 2-7 illustrate a modification of the invention wherein the bottom surface 16 includes a first magnetic plate 17 magnetically attracted to a second magnetic plate 18 that is mounted to a rear surface of the clock member 15 to permit selective removal of the clock member therefrom. A third magnetic plate 19 mounted to an exterior surface of the hat shell 11 is magnetically attracted to a fourth magnetic plate 20 that is fixedly mounted to a fiber optic cable housing 21 to permit selective removal of the housing relative to the hat shell 11. An illumination bulb 27 is mounted within the housing 21 cooperative with an on/off switch 21*a* through a battery 28 to effect selective illumination of the bulb 27. A fiber optic cable sheath 22 is positioned adjacent the illumination bulb 27 at a rear terminal end of the fiber optic sheath 22 positioning each rear terminal end of each fiber optic cable adjacent the illumination bulb 27, wherein each of the fiber optic cables is directed through the sheath in proximity to the clock member 15. The matrix of fiber optic cables directed through the sheath includes a respective first, second, third, and fourth fiber optic cable 23, 24, 25, and 26 respectively. Each fiber optic cable of the matrix of fiber optic cables includes a projection end, wherein each projection end of the four cables is directed radially and fixedly into the side of the clock housing of the clock member 15, with each projection end spaced apart ninety degrees for illumination of each time quadrant to include the twelve o'clock position, the three o'clock position, the six o'clock position, and the nine o'clock position of the first through fourth fiber optic cables respectively. To this end, a respective first, second, third, and fourth projection end 23*a*, 24*a*, 25*a*, and 26*a* respectively is projected within the clock face for illumination of each time quadrant of each respective numeral as discussed above.

Accordingly, it may be appreciated that visibility of the clock member during periods of limited light availability is provided.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A construction hat timepiece apparatus, comprising, a hat shell defining a generally semi-spherical configuration, including a concave cavity, with the hat shell including a lower continuous edge, and the lower continuous edge mounting a brim flange fixedly thereto, with the brim flange extending exteriorly of the hat shell, and the brim flange including a bottom surface, the bottom surface mounting a clock member thereon, and wherein the bottom surface includes a first magnetic plate, and the clock member includes a rear face, the rear face mounting a second magnetic plate fixedly thereto, wherein the second magnetic plate is magnetically attractive to the first magnetic plate for selective mounting of the clock member to the first magnetic plate, and further including a fiber optic cable housing, the fiber optic cable housing mounting a fourth magnetic plate fixedly thereto, with the hat shell mounting a third magnetic plate to an exterior surface of the hat shell to permit selective securement of the fourth magnetic plate to the third magnetic plate, and a fiber optic cable matrix directed from the fiber optic cable housing to the clock member to effect selective illumination of discrete portions of the clock member, and wherein the fiber optic cable housing includes an illumination bulb contained therewithin, and a battery positioned within the fiber optic cable housing, and an on/off switch, wherein the on/off switch effects selective illumination of the illumination bulb, and the fiber optic cable matrix is positioned adjacent the illumination bulb at a rear terminal end of the fiber optic cable matrix, and further including a sheath in surrounding relationship relative to the fiber optic cable housing interiorly of the housing, and wherein the fiber optic cable sheath extends exteriorly of the housing surrounding the fiber optic cable matrix, and the fiber optic cable matrix includes respective first, second, third, and fourth fiber optic cable, and wherein a respective first, second, third, and fourth fiber optic cable include a respective first, second, third and fourth respective projection end, each projection end extending radially into and fixedly mounted through a side of a clock housing mounting the clock member, and the clock member including a forward face, wherein each projection end is positioned on the forward face of the clock member, and each projection end is spaced apart ninety degrees relative to an adjacent projection end.

2. An apparatus as set forth in claim 1 wherein the first projection end is positioned at a twelve o'clock position on the clock member, the second projection end is positioned on a three o'clock position of the clock member, the third projection end is positioned on a six o'clock position of the clock member, and the fourth projection end is positioned on the nine o'clock position of the clock member.

* * * * *